United States Patent [19]

Kulig

[11] 4,081,019

[45] Mar. 28, 1978

[54] SYNTHETIC RESIN PREFORM AND SPRUE ASSEMBLY AND METHOD OF MAKING SAME

[75] Inventor: Frank M. Kulig, Bloomfield, Conn.

[73] Assignee: The J. M. Ney Company, Bloomfield, Conn.

[21] Appl. No.: 639,877

[22] Filed: Dec. 11, 1975

[51] Int. Cl.[2] ..... B22C 7/02; B22C 9/04

[52] U.S. Cl. ..... 164/34; 164/244; 164/246; 164/DIG. 4; 29/434; 29/469

[58] Field of Search ..... 264/16, 221, 317; 164/DIG. 4, 244, 45, 34, 35, 36, 246, 249; 29/434, 469

[56] References Cited

U.S. PATENT DOCUMENTS

| | | | |
|---|---|---|---|
| 1,225,206 | 5/1917 | Atkinson | 164/DIG. 4 |
| 1,595,338 | 8/1926 | Brayda et al. | 164/244 |
| 2,065,977 | 12/1936 | Jefferies | 164/DIG. 4 |
| 3,340,923 | 9/1967 | Benfield | 164/244 |
| 3,587,722 | 6/1971 | Slansky | 164/34 X |
| 3,610,317 | 10/1971 | Benfield | 164/35 X |
| 3,648,760 | 3/1972 | Cooper | 164/35 X |
| 3,768,544 | 10/1973 | Podeh | 164/DIG. 4 X |
| 3,939,898 | 2/1976 | Petro et al. | 164/244 X |

*Primary Examiner*—Robert D. Baldwin

[57] ABSTRACT

A synthetic sprue forming assembly comprises a base or preform adapted for engagement with a crucible former, a plurality of sprue formers, and one or more conduit forming shafts extending between the base and sprue formers. Each sprue former consists of a first portion connected to a shaft, a gate portion, and an enlarged reservoir portion therebetween. In one embodiment, there are a pluality of integral sprue pins seated in recesses in the base and each comprising a shaft portion and a sprue former portion extending at an angle to the longitudinal axis of the shaft. In another embodiment, there is one large shaft integral with the base, and the reservoir and gate portions are integrally formed and rotatably and detachably mounted to a conduit portion on the large shaft. In the method of making an investment mold, the base and sprue formers are assembled on a crucible former in an investment mold container. After a pattern is mounted on the gate portions of the assembly, the mold container is filled with investment material which is allowed to set, and the assembly is fired to burn out the sprue forming elements and pattern and form the investment mold.

19 Claims, 6 Drawing Figures

SYNTHETIC RESIN PREFORM AND SPRUE ASSEMBLY AND METHOD OF MAKING SAME

BACKGROUND OF THE INVENTION

Sprue pins for use in the production of dental and other castings using the lost wax process have been known for some time and are available in various configurations, the most common form consisting of a metal or synthetic resin rod upon which a pattern is mounted. These pins may be mounted directly upon crucible formers and generally permit little facile adjustment of the orientation thereof which is desirable to accommodate the wide variety of casting requirements. It is also quite difficult to utilize two or more of these pins to support and to feed different parts of a relatively large pattern. Furthermore, since these pins are mounted directly and individually to crucible formers, the formers must often have specifically configured mounting portions dependent on the particular application.

Exemplary of another type of synthetic resin sprue pin is that of U.S. Pat. No. 3,340,923 granted to J. W. Benfield on Sept. 12, 1967. Benfield's sprue pin comprises a hollow shaft having an enlarged reservoir portion intermediate its length, the reservoir functioning to provide a cavity for a supply of molten metal during the casting procss which minimizes shrinkage porosity in the casting.

Another type of synthetic resin sprue pin is that of French Letters Patent No. 1,115,559 which comprises a central shaft having a multiplicity of axially and circumferentially spaced branches or runners extending outwardly therefrom. This sprue pin, although it does permit a number of patterns to be mounted thereon, is not adjustable to accommodate patterns of varied configurations.

Accordingly, it is an object of the present invention to provide a novel synthetic resin preform and sprue assembly which is readily and inexpensively manufactured and which permits facile mounting and adjustment of the sprue members thereof to meet the requirements of a wide variety of casting applications.

It is also an object to provide such a preform and sprue assembly wherein the angular orientation of the sprue members is easily adjusted to provide clearance between patterns and to facilitate mounting relatively large patterns upon a plurality of sprue formers.

Another object is to provide such a preform and sprue assembly which permits use of a standard crucible former.

Still another object is to provide a novel and facile method for making investment molds using such a preform and sprue assembly.

SUMMARY OF THE INVENTION

A synthetic resin preform and sprue assembly comprises a base or preform for engagement with a crucible former, a plurality of sprue formers spaced from the base, and conduit forming means extending between the base and sprue formers. The sprue formers each comprises a first portion connected to and extending outwardly from the conduit forming means and a reservoir portion and gate portion at the free end thereof. The reservoir portion has a cross section enlarged relative to that of the first and gate portions, the gate portions being adapted for supporting a pattern thereon whereby a plurality of sprues in communication with a crucible portion may be formed in an investment by firing a ceramic composition containing the preform and sprue assembly.

One embodiment of the present invention has a plurality of sprue pins each comprising a shaft portion mounted on the base, a gate portion spaced from an end of the shaft portion, and a reservoir portion therebetween. In the preferred aspect each sprue pin is integrally formed, the free end of each shaft rotatably seats in a recess in the base, and each shaft has a bend intermediate its length.

In another embodiment of the present invention the conduit means comprises a single shaft which is preferably integrally formed with the base. Each of the sprue former first portions provides a runner the free end portion of which is seated for relative rotation in a recess in one of the reservoir portions. Each gate portion extends at an angle to the longitudinal axis of its corresponding runner and is integrally formed with a reservoir portion.

A method of making an investment mold utilizing the first preform and sprue pin embodiment has steps comprising mounting a synthetic resin preform having a plurality of recesses in its exposed surface on a crucible former, inserting into the recesses in the preform a plurality of elongated synthetic resin sprue pins each having an enlarged reservoir portion intermediate its length, and mounting a pattern on the free ends of the sprue pins. Additional steps comprise forming a container within which is seated the preform and sprue pins and into which projects the crucible former, filling the container with a refractory material, causing the refractory material to set about the pattern, sprue pins, preform, and crucible former, and firing the refractory material to burn out the pattern, sprue pins, and preform whereby a crucible, mold cavity, and sprue extending therebetween with a reservoir therein are formed by cavities therewithin.

A method of making an investment mold utilizing the second preform and sprue pin embodiment has steps comprising mounting on a crucible former an elongated sprue tree having a plurality of conduit formers spaced along the length and about the periphery thereof, mounting on the conduit formers of the sprue tree a plurality of sprue elements each having a gate portion spaced from one of the conduit formers and a reservoir portion therebetween, and mounting a pattern on the free end of the gate portions. Additional steps comprise forming a container within which is seated the sprue tree, conduit formers, and sprue elements and into which projects the crucible former, filling the container with a refractory material, causing the refractory material to set about the pattern, sprue tree, conduit formers, sprue elements and crucible former, and firing the refractory material to burn out the pattern, sprue tree, conduit formers, and sprue elements whereby a crucible, mold cavity, and sprue extending therebetween with a reservoir therein are formed by cavities therewithin.

DETAILED DESCRIPTION OF THE ILLUSTRATED EMBODIMENTS

Figure 1:
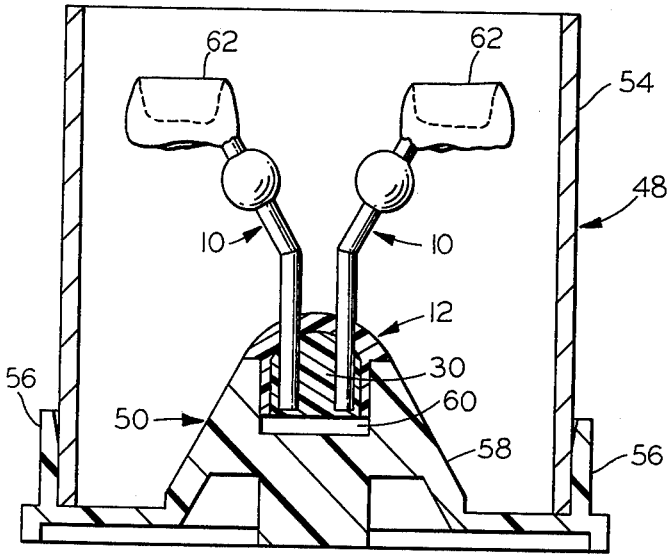
FIG. 1 is a sectional view of an investment mold assembly showing a preform and sprue assembly embodying the present invention.
Figure 2:
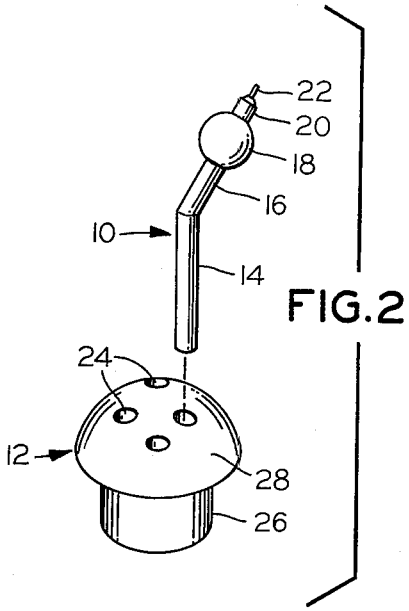
FIG. 2 is an exploded perspective view of the sprue and preform assembly of FIG. 1.

Turning now to the attached drawing in detail and in particular to FIGS. 1–2 thereof, illustrated therein is a preform and sprue assembly embodying the present invention which comprises a sprue pin generally designated by the numeral 10 and a base or preform generally designated by the numeral 12.

Each sprue pin 10 is an elongated member integrally formed or synthetic resin and has a cylindrical shaft or conduit portion 14 which comprise conduit forming means, a cylindrical portion 16 extending at an angle to the longitudinal axis of the shaft portion 14, an enlarged spherical reservoir portion 18, and a cylindrical gate portion 20 coaxial with the portion 16. Cylindrical portion 14, reservoir portion 18 and gate portion 20 together comprise a sprue former. The gate portion 20 includes a mounting pin portion 22 of reduced diameter extending coaxially of the free end thereof for a purpose to be described hereinafter.

Each sprue pin 10 is rotatably mounted on the base 12 by inserting the free end portion of the shaft 14 into one of the cylindrical apertures 24. As seen, the base 12 is integrally formed from synthetic resin with an umbrella shaped configuration defined by a cylindrical tubular body portion 26 and a cap portion 28 of greater diameter. As shown in FIG. 1, the tubular body portion 26 is intended to receive wax 30 or other deformable material to facilitate securing the sprue pins 10 in position. As also shown in FIG. 1, the free end portions and cylindrical apertures or recesses are relatively sized so that the portions are coaxially aligned with the recesses.

The base or preform 12 is mounted in an investment mold or container generally designated by the numeral 48 which comprises a crucible former generally designated by the numeral 50 and a metallic cylindrical ring 54. The crucible former 50 has an upstanding annular flange 56 extending about the periphery thereof which fits tightly about the lower portion of the ring 54. At its center, the crucible former 50 has a generally frustoconical central portion 58 with a cylindrical cavity 60 in the top thereof configured to seat the body portion 26 of the base 12.

Another embodiment of the present invention is shown in FIGS. 3–6 wherein there is utilized a synthetic resin sprue tree generally designated by the numeral 32 to which are secured a plurality of gate and reservoir formers each comprised of a relatively large diameter spherical reservoir portion 34 and a cylindrical gate portion 36 with a mounting pin 38 of relatively small diameter extending coaxially at the free end thereof.

The sprue tree 32 comprises an umbrella shaped base portion 40 and the hollow cylindrical shaft portion 42 formed integrally therewith. the base portion 40 has a tubular cylindrical body or insert portion 43 which seats in the recess 60 of the crucible former 50. In the illustrated version of this embodiment, the sprue tree 32 includes separately formed cylindrical runners or conduits 44 which seat snugly in apertures in the shaft 42; the runner **44*a* extends completely through the shaft 42 while the runner 44*b* extends inwardly of the shaft 42 into abutment with runners 44*a*. The runners 44 terminate in free ends. The sprue formers are comprised of the runners 44 extending outwardly from shaft 42, reservoir portion 34, and gate portion 36. Shaft 42 provides the conduit forming means. To eliminate the need for assembling the runners 44 to the shaft 42, the runners 44 may be formed integrally with the tree 32 as cylindrical projections or bosses on the exterior surface of the shaft 42. As will be noted from the drawings, particularly FIGS. 3, 4 and 6, the runners 44 extend along a first axis and the gate portions 36 extend along a second axis which is disposed at an angle to the first axis. The reservoir portions 34** are rotatably mounted on the runners.

Each reservoir portion 34 has a cylindrical recess 46 in the outer surface thereof and is rotatably and detachably mounted upon the sprue tree 32 by seating the free end of a runner 44 in the recess 46. Each gate portion 36 extends at an angle to its corresponding runner 44 to facilitate achieving the desired angular orientation thereof within the mold and relative to adjacent elements.

The manner of using the preform and sprue assemblies to make castings using the lost wax process will now be described, and inasmuch as the two embodiments described above function in generally the same manner the description will focus on the embodiment of FIGS. 1 and 2 with appropriate references to the embodiment of FIGS. 3–6.

Initially, the base or preform 12 is filled with a wax 30 which is pliable at room temperature and is then inserted into the recess 60 of the crucible former 50 which has been previously assembled on the ring 48. The sprue pins 10 are then inserted into the apertures 24 of the base 12 as desired for feeding the mold cavities intended. Finally, the wax patterns 62 are secured in place on the ends of the sprue pins 10. Alternatively, the wax patterns 62 may be mounted on the sprue pins 10 prior to inserting them into the apertures 24. The patterns may be oriented by adjustment of the angular orientation of the sprue pins 10 (or of elongated members comprising the sprue pins) by rotation of the sprue pins 10 (elongated members) relative to the base 12.

In using the embodiment of FIGS. 3–6, the body portion 43 is inserted into the cavity 60 of the crucible former 50 on which is similarly seated a casting ring 54 (not shown). Thereafter the reservoir portions 34 are mounted on the runners or conduit formers 44 with the gate portions at the desired orientation, and wax patterns (not shown in FIGS. 3–6) are mounted on the gate portions 36 and mounting pins 38. Alternatively, patterns may be mounted on the gate portions and mounting pins prior to mounting the assembly on a runner.

Once the preform, sprue assemblies, and patterns have been mounted in the casting ring 54 it is filled with a refractory material (not shown) which is allowed to set. The crucible former 50, which is generally fabricated from a combustible material, is then removed to permit reuse thereof leaving the plastic elements and wax patterns imbedded in the refractory material which has a recess in its surface corresponding to the contour of the now removed crucible former 50.

The mold 48 is then fired at elevated temperatures to provide the desired refractory mold whereby the synthetic resin and wax members are burned out with a crucible, mold cavity(ies), and sprue(s) therebetween being formed. Although the wax patterns 62 generally melt at lower temperatures than do the synthetic resin members, tests have shown that there is no significant pressure increase in the cavities formed by the patterns 62 as the refractory material is sufficiently permeable to allow gas diffusion therethrough.

Figure 3:
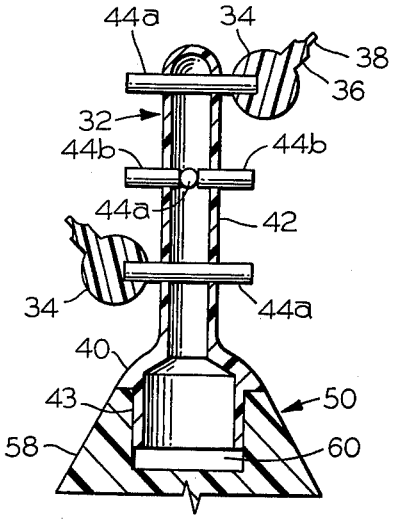
FIG. 3 is a fragmentary cross sectional view of a mold assembly utilizing another embodiment of preform and sprue assembly.
Figure 4:
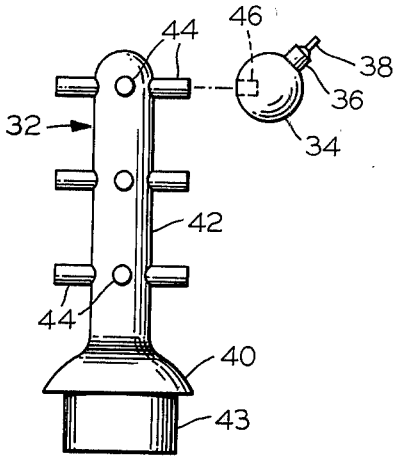
FIG. 4 is a partially exploded elevational view of the preform and sprue embodiment of FIG. 3.
Figure 5:
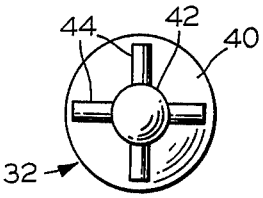
FIG. 5 is a fragmentary plan view of the preform and sprue embodiment of FIG. 3.
Figure 6:
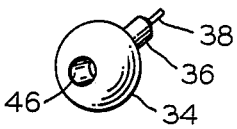
FIG. 6 is a perspective view of a sprue reservoir and gate portion of the embodiment of FIG. 3.

After the wax and synthetic resin members are burned out the mold 48 is inverted and is ready to be used to cast dental structures. As seen in FIGS. 1 and 3, the configuration of the crucible former central portion 58 and bases 12, 40 provides a smooth-walled crucilbe and, during setting of the refractory material, prevents any leakage thereof into the joint between the two members. The molten metal in the reservoir portions 18, 34 during casting functions to prevent indue shrinkage of the metal in the mold cavity.

The versatility of the preform and sprue member assembly of the present invention is enhanced by rotation of the offset reservoir sprue pins 10 relative to the base 12 and by rotation of the reservoir portions 34 relative to the runners 44 in the embodiment of FIGS. 3–6. As a result, the gate portions 20, 36 and mounting pins 22, 38 may be oriented and positioned as required by the particular casting layout to provide necessary clearance between patterns or to mount a large pattern on more than one gate portion. Rotation of the sprue pins 10 is, as is apparent from FIG. 1, about an axis defined by the longitudinal axis of the free end portion thereof.

The sprue pins 10 are preferably solid and integrally formed for strength, but may be hollow or comprise separate elements depending on the casting requirements. The base 12 is hollow to save costs but may be solid with the recesses therein being configured to seat the sprue pins snugly.

The sprue tree shaft 42 is preferably hollow for economy with the runners, reservoir and gate portions being solid to provide a strong structure. Instead of mounting reservoir portions on runners, sprue pins similar to those in FIGS. 1 and 2 may be inserted directly into recesses in the sprue tree shaft. With reference to these latter two structural alternatives, the method claim reference to conduit formers is meant to include both runners extending from the sprue tree shaft and recesses in the shaft.

The elements of the preform and sprue assembly are preferably formed of acrylic resins which have a melting temperature on the order of 400° F., athough other synthetic resins may be used including polypropylene, polycarbonate, polyethylene, polyamide, etc.

Thus, it can be seen that the present invention provides a novel synthetic resin preform and sprue assembly which is readily manufactured and which permits facile mounting and adjustment of the sprue members thereof to orientation of the sprue members is easily adjusted to provide clearance between patterns and to facilitate mounting relatively large patterns on a plurality of sprue members. The invention uses a crucible former adapted to seat either type of preform and sprue assembly, and provides a novel and facile method for making investment molds using such a preform and sprue assembly.

I claim:

1. In a method of making an investment mold, the steps comprising:

a. mounting a synthetic resin preform having a plurality of circular cross section recesses in its exposed surface on a crucible former;

b. inserting into a plurality of said recesses in said preform respective ones of a plurality of elongated synthetic resin sprue pins each having a conduit portion having a circular cross section end portion, said recesses and said circular cross section end portions being relatively sized so that said end portions are coaxially aligned with said recesses to seat the respective end portions for rotation within a respective one of said recesses, said sprue pins further having a bend and an enlarged reservoir portion intermediate its length;

c. mounting patternson the free ends of said sprue pins, and d. orienting the patterns by adjusting the angular orientation of said sprue pins by rotating said sprue pins about said end portions relative to said synthetic resin preform.

2. In the method of claim 1, the additional steps comprising:

a. forming a container within which is seated said preform and said sprue pins and into which projects said crucible former;

b. filling said container with a refractory material;

c. causing said refractory material to set about said pattern, sprue pins, preform, and crucible former; and d. firing said refractory material to burn out said pattern, sprue pins, and preform whereby a crucible, mold cavity, and sprue extending therebetween with a reservoir therein are formed by cavities therewithin.

3. In a method of making an investment mold, the steps comprising:

a. mounting on a crucible former an elongated sprue tree having a plurality of conduit formers each having a free end portion of circular cross section and spaced along the length and about the periphery of said spruce tree;

b. mounting on the conduit formers of said sprue tree a plurality of sprue elements each having a gate portion spaced from one of said conduit formers and a reservoir portion therebetween, said reservoir portion having a circular cross section recess formed therein non-coaxially relative to its gate portion whereby said reservoir and gate portions are mounted for rotation about their respective conduit formers;

c. mounting a pattern on the free end of said gate portions; and d. orienting the patterns by adjusting the angular orientations of said gate portions by rotating said reservoirs about their respective conduit formers.

4. In the method of claim 3, the additional steps comprising:

a. forming a container within which is seated said sprue tree, conduit formers, and sprue elements and into which projects said crucible former;

b. filling said container with a refractory material;

c. causing said refractory material to set about said pattern, sprue tree, conduit formers, sprue elements and crucible former; and d. firing said refractory material to burn out said pattern, sprue tree, conduit formers, and sprue elements whereby a crucible, mold cavity, and sprue extending therebetween with a reservoir therein are formed by cavities therewithin.

5. A synthetic resin preform and sprue assembly comprising a base for engagement with a crucible former, a shaft connected to said base, and a plurality of sprue formers each comprising a runner connected to said shaft and having a free end extending therefrom along a first axis, a gate portion spaced from the free end of said runner and extending along a second axis disposed at an angle to the first axis, and a reservoir portion therebetween, said shaft having a large cross sectional area relative to that of said runners and said reservoir portions having enlarged cross sections relative to those of said runners and gate portions and being rotatably mounted on said runners, said gate portions being adapted for supporting a pattern thereon whereby a pattern may be disposed on the free end of a gate portion and a plurality of sprues in communication with a crucible portion may be formed in an investment by firing a ceramic composition containing the preform and sprue assembly.

6. The synthetic resin preform and sprue assembly of claim 5 wherein said shaft and said base are integrally formed.

7. The synthetic resin preform and sprue assembly of claim 5 wherein each of said reservoir portions is formed integrally with one of said gate portions.

8. A synthetic resin preform and sprue assembly comprising a base for engagement with a crucible former, said base having a plurality of seating recesses formed therein, a plurality of sprue formers spaced from said base, and conduit forming means extending between said base and said sprue formers, said conduit forming means and said sprue formers are elongated members formed with said sprue formers extending at an angle to its corresponding conduit forming means, said conduit forming means each having an end portion seated in one of said recesses, said recesses and said end portions having circular cross sections and being relatively sized so that said end portions are coaxially aligned with said recesses, whereby said elongated members are rotatably mounted in said recesses, said sprue formers each comprising a first portion connected to and extending outwardly from said conduit forming means, a gate portion spaced therefrom, and a reservoir portion therebetween, said reservoir portion having an enlarged cross section relative to that of said first and gate portions, and said gate portion being adapted for supporting a pattern thereon whereby a pattern may be disposed on the free end of a gate portion of each of the sprue formers and the patterns may be oriented by adjustment of the angular orientation of said elongated members by rotation of said members relative to said base about said end portions, and a plurality of sprues in communication with a crucible portion may be formed in an investment by firing a ceramic composition containing the preform and sprue assembly.

9. The synthetic resin preform and sprue assembly of claim 1 wherein said elongated members are integrally formed.

10. A synthetic resin preform and sprue assembly comprising a base for engagement with a crucible former, a plurality of sprue formers spaced from said base, and conduit forming means extending between said base and said sprue formers, said sprue formers each comprising a first portion connected to and extending outwardly from said conduit forming means and terminating in a free end portion, a gate portion spaced therefrom, and a reservoir portion therebetween, said reservoir portions having an enlarged cross section relative to that of said first and gate portions and further having a recess formed therein with the free end portion of one of said sprue member first portions being seated in each of said recesses whereby said reservoir portions are rotatably mounted on said free end portions of said sprue member first portions with each of said gate portions extending at an angle to the longitudinal axis of its corresponding sprue member first portion whereby rotation of said reservoir portions provides a desired position and orientation of said gate portions, and said gate portions being adapted for supporting a pattern thereon whereby a pattern may be disposed on the free end of a gate portion of the sprue formers and a plurality of sprues in communication with a crucible portion may be formed in an investment by firing a ceramic composition containing the preform and sprue assembly.

11. The synthetic resin preform and sprue assembly of claim 10 wherein said conduit forming means comprises a shaft of large cross sectional area relative to that of said first portions of said sprue formers.

12. The synthetic resin preform and sprue assembly of claim 11 wherein said base and said shaft are integrally formed.

13. The synthetic resin preform and sprue assembly of claim 11 wherein each of said reservoir portions is formed integrally with one of said gate portions.

14. A synthetic resin preform and sprue assembly comprising a base for engagement with a crucible former and a plurality of sprue pins each comprising a shaft portion having a bend intermediate its length mounted on said base, said base having seating recesses formed therein with each of said sprue pin shaft portions including an end portion and being seated in one of said recesses, and said recesses and shaft portions having circular cross sections and being relatively sized so that said end portions are coaxially aligned with said recesses whereby said sprue pins are rotatably mounted in said recesses, a gate portion spaced from said end portion of said shaft portion, and a reservoir portion therebetween, said reservoir portion having an enlarged cross section relative to that of said shaft and gate portions, and said gate portions being adapted for supporting a pattern thereon whereby a pattern may be disposed on the free end of a gate portion of the sprue pins and the patterns so disposed may be oriented by adjustment of the angular orientation of said sprue pins by rotation thereof relative to said base, and a plurality of sprues in communication with a crucible portion may be formed in an investment by firing a ceramic composition containing the preform and sprue assembly.

15. The synthetic resin preform and sprue assembly of claim 14 wherein each of said sprue pins is integrally formed.

16. A synethic resin preform and sprue assembly comprising a base for engagement with a crucible former, a shaft connected to said base, and a plurality of sprue formers each comprising a runner connected to said shaft and extending therefrom and terminating in a free end, a gate portion spaced from the free end of said runner, and a reservoir portion therebetween, said reservoir portions having a recess formed therein with the free end portion of one of said runners being seated in each of said recesses, wherein said reservoir portions are rotatably mounted on said runners with each of said gate portions extending at an angle to the longitudinal axis of its corresponding runner whereby rotation of said reservoir portions provides a desired position and orientation of said gate portions, and wherein said shaft has a large cross sectional area relative to that of said runners and said reservoir portions have enlarged cross sections relative to those of said runners and gate portions, said gate portions being adapted for supporting a pattern thereon whereby a pattern may be disposed on the free end of a gate portion and a plurality of sprues in communication with a crucible portion may be formed in an investment by firing a ceramic composition containing the preform and sprue assembly.

17. In a mold forming assembly, the combination comprising:

a. a crucible former having a generally dome-shaped portion with an upwardly opening coaxial recess therein; and b. a synthetic resin preform and sprue assembly seated in said recess of said crucible former, said synthetic resin preform and sprue assembly comprising a base having a peripheral configuration conforming to said recess and seated snugly therein, said base having a plurality of upwardly opening circular cross section seating recesses formed therein, a plurality of sprue formers spaced from said base, and conduit forming means extending between said base and said sprue formers, said conduit forming means having end portions of circular cross section adapted to be seated within said seating recesses, and said circular cross section end portions and said seating recesses being respectively sized so that said end portions are coaxially aligned with said seating recesses for rotation therein, said sprue formers each comprising a first portion connected to and extending outwardly from said conduit forming means at an angle relative thereto, a gate portion spaced therefrom, and a reservoir portion therebetween, said reservoir portion having an enlarged cross section relative to that of said first and gate portions, and said gate portions being adapted for supporting a pattern thereon whereby a pattern may be disposed on the free end of a gate portion of the sprue formers and the pattern may be oriented by adjustment of the angular orientation of the conduit forming means by rotation thereof in said seating recesses about said end portions, and a plurality of sprues in communication with a crucible portion may be formed in an investment by firing a ceramic composition containing the preform and sprue assembly.

18. The mold forming assembly of claim 17 wherein a plurality of integrally formed elongated members is provided, each having an end portion seated in one of said seating recesses and providing an integral conduit forming means and sprue former.

19. The mold forming assembly of claim 17 wherein said conduit forming means comprises a shaft of large cross sectional area relative to that of said first portions of said sprue formers.

* * * * *

UNITED STATES PATENT AND TRADEMARK OFFICE

CERTIFICATE OF CORRECTION

PATENT NO. : 4,081,019

DATED : March 28, 1978

INVENTOR(S) : Frank M. Kulig

It is certified that error appears in the above-identified patent and that said Letters Patent are hereby corrected as shown below:

Column 6, line 38, "spruce tree" should be --sprue tree--;

Column 7, line 55, "Claim 1" should be --Claim 8--.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*